US005311196A

United States Patent [19]

Hanson et al.

[11] Patent Number: 5,311,196

[45] Date of Patent: May 10, 1994

[54] OPTICAL SYSTEM FOR MICROWAVE BEAMFORMING USING INTENSITY SUMMING

[75] Inventors: Donald W. Hanson, Rome, N.Y.; David L. Fried, Monterey, Calif.

[73] Assignee: The United States of America as represented by the Secretary of the Air Force, Washington, D.C.

[21] Appl. No.: 95,024

[22] Filed: Jul. 16, 1993

[51] Int. Cl.[5] ..... H01Q 3/22; H01Q 3/24

[52] U.S. Cl. ..... 342/368; 342/154

[58] Field of Search ..... 342/368, 372, 371, 154, 342/157

[56] References Cited

U.S. PATENT DOCUMENTS 3,878,520 4/1975 Wright et al. ..... 343/854
4,583,096 4/1986 Bellman et al. ..... 343/368
4,814,773 3/1989 Wechsberg et al. ..... 342/368
4,885,589 12/1989 Edward et al. ..... 342/175
4,965,603 10/1990 Hong et al. ..... 342/372
5,029,306 7/1991 Bull et al. ..... 342/368

*Primary Examiner*—Theodore M. Blum
*Attorney, Agent, or Firm*—Jacob N. Erlich; William G. Auton

[57] ABSTRACT

An optically based feed structure is used to distribute appropriately phased signals from a central signal generator to the individual elements of a phased array antenna. Any phase can be generated by adding together four phased signals (phased by 90 degree increments) if the amplitudes of the individual phased signals are appropriately controlled. By appropriately controlling the amplitude of the individual phased signals the amplitude of the resultant can also be controlled. In many cases it is desired to keep this amplitude constant. In some cases an amplitude taper across the phased array is desired.

25 Claims, 3 Drawing Sheets

OPTICAL SYSTEM FOR MICROWAVE BEAMFORMING USING INTENSITY SUMMING

STATEMENT OF GOVERNMENT INTEREST

The invention described herein may be manufactured and used by or for the Government for governmental purposes without the payment of any royalty thereon.

The invention described herein may be manufactured and used by or for the Government for governmental purposes without the payment of any royalty thereon.

BACKGROUND OF THE INVENTION

The present invention relates generally to microwave antennas, and more specifically the invention pertains to an optical feed structure for controlling microwave phased array antennas.

A phased array antenna is a network of radiating elements, having a cooperative radiation pattern that is a highly directive beam. Whereas conventional radar antennae have to be mechanically steered to meet beam directing requirements, a phased array achieves the same effect electronically by changing the phase of the signal radiated by each element. Thus, accurate beams are formed and directed simply by driving each element of the array with a signal having an appropriate phase. As a further advantage, electronic steering is much faster than mechanical steering.

The flexibility of electronic steering provided by phased arrays requires individual control of each element. In an array having N elements, each of the elements is driven with a different phase of the same signal.

Electronically scanned radars include a feed network which couples microwave energy from the transmitter to a radiating aperture of the antenna, as well as from the aperture to the receiver. Feed networks are constructed in a variety of forms, with the corporate feed being particularly useful in providing an accurate distribution of microwave energy across the radiating aperture.

The task of providing an optical system for controlling microwave phased array antennas is alleviated to some extent by the systems disclosed in the following U.S. patents, the disclosure of which are specifically incorporated herein by reference:

U.S. Pat. No. 4,956,603 issued to Hong et al;

U.S. Pat. No. 4,814,773 issued to Wechsberg et al;

U.S. Pat. No. 4,583,096 issued to Bellman, et al; and

U.S. Pat. No. 3,878,520 issued to Wright et al.

The patents identified above relate to fiber optic network apparatus for phased array radar systems. In particular, the Hong et al. patent describes an optical beamforming network for controlling the RF radiation pattern of a phased array antenna. A spatial light modulator is user-programmed with a desired far field radiation footprint, and modulates the light from a laser. The modulated light beam is directed through a Fourier transform lens and onto a beam splitter. The light is then combined with light from a second laser that is frequency offset by the RF center frequency of the antenna. Light from the beam splitter is recovered by first and second fiber optic bundles, and each optical fiber leads to a corresponding photodetector. The outputs of corresponding photodetectors of the two fiber optic bundles are combined to control the radiation of a corresponding radiation element of the phased array.

The Wechsberg et al patent relates to an optical feed system capable of coupling an antenna with transmitting and receiving circuity. The feed system comprises a set of optical multiplexers interconnected by sets of optical fibers. The microwave energy of the radar is converted to optical radiation for communication to the antenna, where it is converted back to microwave energy. Electro-optic modulators and photoelectric detectors provide the energy conversion. A plurality of signals can be simultaneously coupled via the optical fibers by utilization of radiation of differing frequencies.

The Bellman et al patent describes a system for fiber optic distribution of data in which digitally encoded data drives an optical light source which illuminates a bundle of fibers. A fiber from this bundle is terminated in the vicinity of each element of one row of a phased array. A photosensor on a transmit/receive element receives the modulated light signal. A similar but independent light source and fiber optic bundle is provided for every row of the array. Similar sources and fiber optic bundles are independently provided for every individual column of the array.

The Wright et al patent relates to an optically operated microwave phased array antenna system. Two optical beams are generated with a difference frequency equal to the desired microwave frequency to be transmitted. The two beams are combined to produce a two dimensional optical pattern that contains the correct microwave phase and amplitude information to form and steer the final antenna beam in space. The optical pattern is actually an optical analog of the microwave excitation applied to the antenna radiating elements. A transducer system converts the optical pattern to a two dimensional microwave pattern which is a two dimensional array of microwave signals. Each signal is connected to a single radiating element of a phased array antenna. These elements cooperate to radiate a beam in space.

The references described above demonstrate an ongoing need for optical control systems for use with microwave phased array antennas. The present invention includes an optical feed structure that is designed to help satisfy that need for both radar and communication microwave antenna systems.

Microwave beamforming in phased array antennas requires that each element of the array transmit a properly phased microwave signal so that the desired far field beam pattern is created. Conventional electronic methods for phased array feed systems tend to be expensive, bulky, lossy, inefficient, and susceptible to electromagnetic interference. Several other optical implementations for microwave beamforming have been proposed. The present invention does not require numerous lossy optical switches as does the switched fiber approach, nor does it require a segmented mirror device.

SUMMARY OF THE INVENTION

The present invention includes an optical microwave beamforming network which electronically steers the output waveform of an antenna of radiating elements. One embodiment of the invention includes: a plurality of lasers, a plurality of modulators, a plurality of banks of variable attenuators, a plurality of detectors, a radar transmitter containing a plurality of amplifiers, and an antenna of radiating elements.

Each of the plurality of lasers outputs a light carrier beam, the light beams are not coherent with each other. Each of the plurality of modulators outputs a modulated light beam by processing one of the light carrier beams from the plurality of lasers. The modulation of each of the modulated light beams has an adjusted phase difference which is determined by the phase of the modulating signal. For example, one specific embodiment of the invention uses four lasers and four modulators so that the modulators output four modulated respective beams with: 0 degree phase shift; 90 degree phase shift; 180 degree phase shift, and 270 degrees of phase shift in the modulation.

Each bank of variable attenuators receives all the outputs of all the laser modulators, and outputs attenuated optical signals to just one detector. By varying the amplitude of individual laser beams which have different modulation phases, the combined outputs of each bank of attenuators can have an adjusted phase difference which is manifested in the electrical RF signal produced by each detector.

Each detector is a photodetector element which electroptically converts the combined output of a single bank of variable attenuators into their electrical equivalent. Suitable photodetectors are known in the art and described in such standard texts as "Optical Radiation Detectors" by E. L. Pereniak et al, the disclosure of which is incorporated herein by reference.

The radio frequency (RF) electrical signals are amplified by the electrical amplifiers in the radar transmitter unit with the adjusted phases between different signals. These adjusted phases result in the electronic steering of the waveform radiated out by the antenna elements as discussed in the above-cited Skolnik reference.

One embodiment of the invention includes the use of a microprocessor as a system controller unit. This embodiment uses the microprocessor to output attenuation control signals for the variable attenuators to control thereby the amounts of attenuation produced by each variable attenuator in its respective optical output signal.

The present invention may also be regarded as a four step process for microwave beamforming. The first step of this process entails producing a plurality of modulated light beams which all are modulated at the same frequency but with separated first differences in the phase of the modulation.

The second step of the process entails adjustably attenuating each of the plurality of light beams to produce thereby a plurality of combined beams which are separated in the modulation phase from each other by second differences in phase.

The third step of the process entails electrooptically converting the plurality of combined beams into RF electrical signals which remain separated from each other by the second differences in phase. This third step is performed by the detectors mentioned above.

The final step of the process entails radiating the RF electrical signals using an array of antenna elements to produce thereby a radiated waveform which is steered by the second differences in phase.

It is an object of the invention to provide an optical microwave beamforming network.

It is another object of the invention to electronically steer the radio frequency output signals of an antenna array by controlling the amplitude of modulated optical signals.

These objects together with objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes an optical feed structure which is used to distribute appropriately phased signals from a central signal generator to the individual elements of a phased array antenna.

A phased array antenna electronically steers a main beam radio frequency output signal by adjusting shifts in signal phase between the radiating elements of the array. The principles of controlling the phased array antenna are explained in such standard texts as "Introduction to Radar Systems" by M. I. Skolnik, the disclosure of which is incorporated herein by reference.

The radar antennas described by Skolnik use entirely electronic signals. The present invention provides an optical feed structure which controls the amplitude and phase of optically modulated laser signals which are converted to electronic signals for radiation from a phased array antenna. More specifically, the present invention is able to adjust the phase of a combined laser signal by a step process. In the first step, four optical laser carrier signals are generated by four separate lasers. These optical laser carrier signals are modulated by signals separated in phase by ninety degrees from each other in the second step, where an optical modulator modulates the four optical laser carrier signals to produce modulated optical signals in the third step a variable attenuator produces four output signals by adjusting the amplitudes of each of the four signals so that when the four output signals are summed in the fourth step, they produce a combined modulated electrical signal with an adjusted phase. This adjusted phase is produced by the summation of the four output signals with each other as discussed below.

In the fourth step, a lens and a detector are used to sum the four output signals of the variable attenuator and convert the resulting output into the combined electrical signal which is amplified by a standard electronic amplifier and radiated out of an array of radiating elements.

The present invention includes the optical feed structure that implements the principles described above. More specifically, the reader's attention is now directed towards FIG. 1, which is an embodiment of an optical feed structure of the present invention which adjusts the phase between signals radiated by two adjacent radiating antenna elements 100 and 150.

Figure 1:
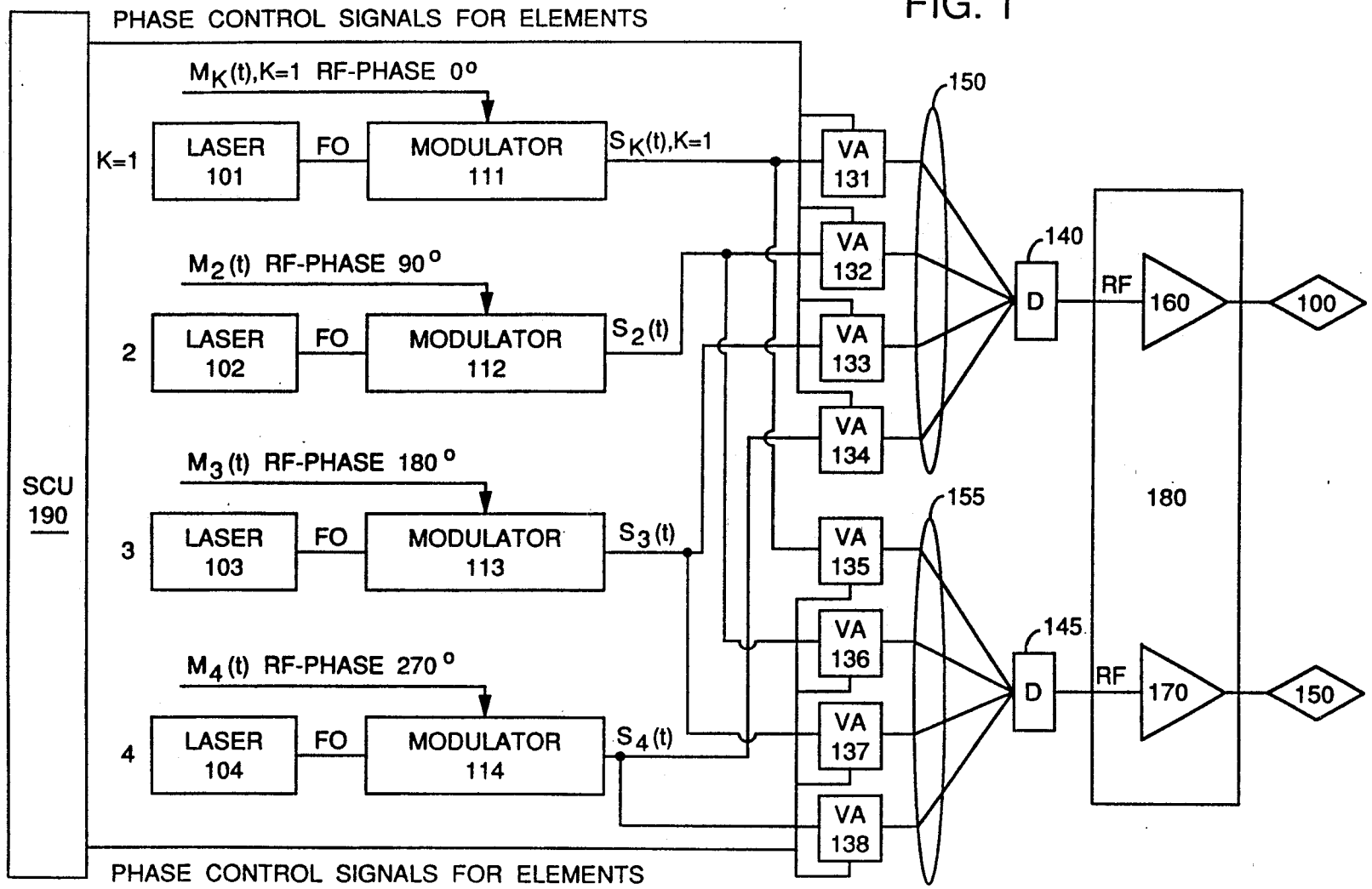
FIG. 1 is a block diagram of the optical microwave beamforming network of the present invention.

The system of FIG. 1 includes four lasers 101–104, four optical modulators 111–114, eight variable attenuators 131–138, two focusing lens elements, 150 and 155, two optical detectors 141 and 145, two amplifiers 160 and 170 (located in transmitter 180), a system controller unit SCU190, and two adjacent radiating elements 100 and 150.

Each of the four lasers 101–104 is a standard laser element such as the ones used in the above-cited Hong et al patent. These lasers output four laser carrier signals none of which is coherent with another.

Fiber optic (FO) lines conduct the respective laser carrier signals from the four lasers 101–104 to four optical modulator elements 111–114. The modulators modulate each beam with the same frequency but at phases separated by 90 degrees between each of the laser carriers. In FIG. 1 the output modulator 111 has zero shift in the modulation phase. The output of modulator 112 has a 90 degree shift in the modulation phase. The output of modulator 113 has a 180 degree shift in the modulation phase. The output of modulator 114 has a 270 degree shift in the modulation phase.

The four optical modulators 114 produce four modulated laser signals which are each separated from each other by a 90 degree shift in the modulation phase. These signals are variably attenuated by the eight variable attenuator units 131–138 to produce eight attenuated output signals which are combined by their respective lenses 150 and 155 optical detectors 140 and 145 to produce two combined modulated electrical signals with controlled and adjusted phases.

The phase control signals for elements 100 and 150 are calculated in the SCU190 and provided as inputs. For simplicity one wire is shown coming in per element; four separate wires or some form of multiplexing using one wire could be used. In either case the bandwidth of these control signal lines would be low compared to the frequency of the RF signal carried on the fiber optic RF signal lines. The phase control signals could be carried on fiber optic lines to enhance immunity to EMI but this would probably not be necessary.

The RF signals of 0°, 90°, 180°, and 270° are inputs into the optical modulators 110–114. An alternate implementation would use one modulator with four separate outputs which are path length matched to provide the 0°, 90°, 180°, and 270° RF phase shifts. This second implementation would be capable of only single frequency operation.

The lasers provide the basic optical signal. It is important that the lasers be incoherent with respect to each other to prevent unwanted optical frequency interference. Standard off-the-shelf lasers meet this criteria. The modulators 111–114 intensity modulate the optical output of the lasers at the RF frequency and phase provided by the RF input signals.

The fiber optic lines (FO) carry the optical signals from the lasers to the modulators and the modulators to the variable attenuators (VA) 131–138. Free space propagation could be used, however, FO signal lines are more practical in the near term.

The variable attenuators 131–138 vary the intensity of the optical signals with the RF modulation, in accordance with the phase control signal inputs, to provide the weighting of each RF phase component necessary to produce the desired RF phase at that element. Many different variable attenuators could be used, (e.g., liquid crystal spatial light modulators, magneto-optic spatial light modulators, Mach Zender modulators).

The lenses 150 and 155 focus the output of each group of variable attenuators, 131–134 and 135–138, onto the detectors (D) 140 and 145 respectively.

The detectors 140 and 145 each sum four optical signals and convert the optical signal into an electrical signal which has a carrier frequency at the RF input frequency and a phase determined by the weighting of the four RF phase components. The output of the detectors would go either directly to the transmitting element, or more likely, to an amplifier then to the transmitting element.

For all other elements the only new signal that is required is the phase control signal; the same optical signals with RF modulation are fed to each element.

As shown in FIG. 1, only four lasers and modulators are required regardless of the number of elements in the array. Some optical feed architectures require a laser and modulator (or a directly modulated laser) per element.

Optical variable attenuators are commercially available. Optical variable path length shifters (i.e., a continuous version of the switched fiber approach) are not commercially available with the variable path lengths necessary to provide the desired RF phase shifts.

One of the four variable attenuators could be replaced by a fixed attenuator. This might limit amplitude control of the signal out of the detector.

Three RF components, spaced at 120° in phase could be used in place of the 4°–90° components. For this implementation one of the variable attenuators could be replaced with a fixed attenuator leaving a requirement for only two variable attenuators. Amplitude control and signal to noise might be compromised in this implementation.

The control is the difference in signal phase between the signals radiated by the two antenna elements 100 and 150. It is achieved by controlling the attenuation of the variable attenuators 131–138. For a simple example, when variable attenuator 131 is the only attenuator in the first bank of attenuators 131–134 producing an output, the first antenna element 100 will radiate a signal that is in phase with the signal produced by modulator 111. By selectively activating the variable attenuators in the second bank of attenuators 135–138, the second antenna element 150 can be made to radiate a signal that is: in-phase with the first antenna element 100 (when only variable attenuators 131 and 135 are producing an output signal); 90 degrees out of phase (when only variable attenuators 131 and 136 are activated); 180 degrees out of phase (when only variable attenuators 131 and 137 are activated); and 270° degrees out of phase (when only variable attenuators 131 and 138 are activated).

The phase adjustment between the output of adjacent antenna elements 100 and 150 is subject to an infinite variety of phase differences by controlling the variable attenuators 131–138 in the manner described below.

Figure 2A:
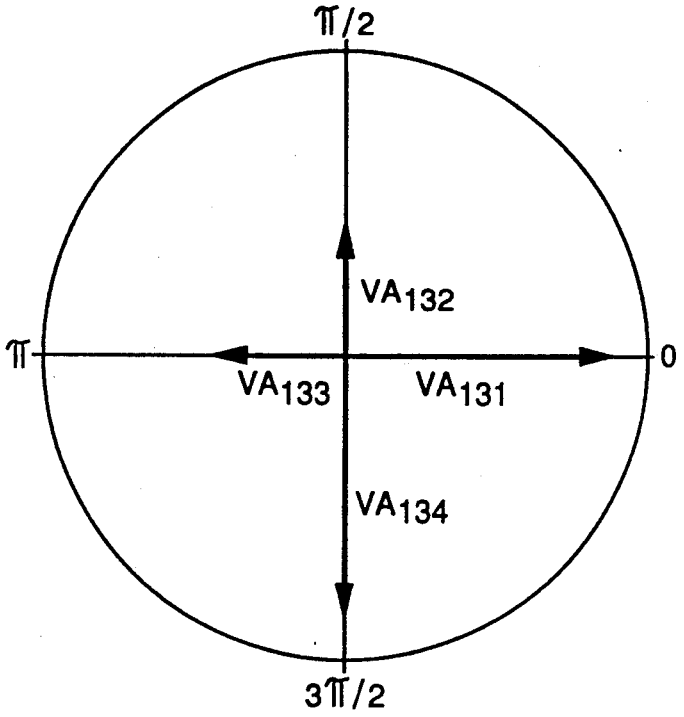
FIG. 2A shows orbitrary basis phasor altitudes as determined by variable attenuators $VA_{131}$ and $VA_{134}$.
Figure 2B:
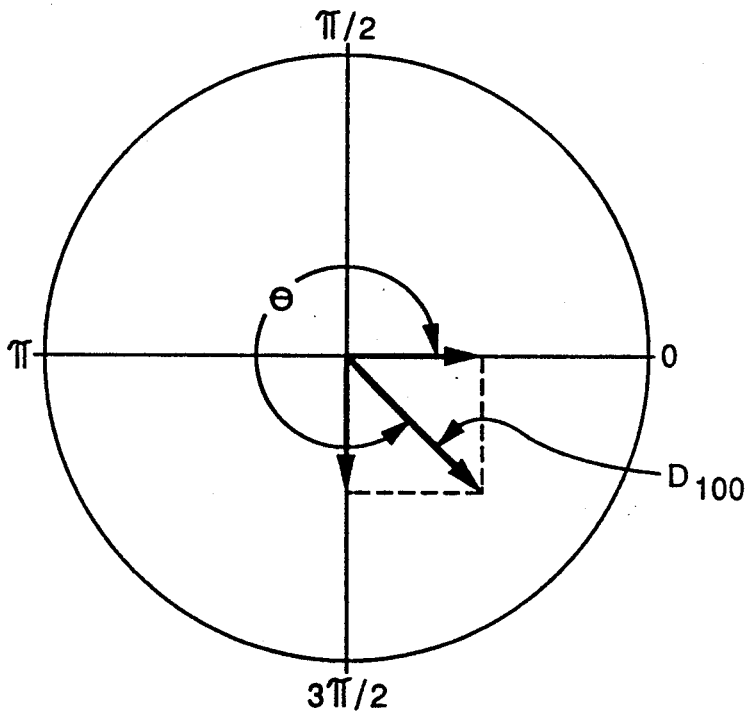
FIG. 2B shows the orbitrary phase and amplitude of $D_{100}(+)$ produced by variable attenuators $V_{131}$ and $VA_{134}$.
Figure 3:
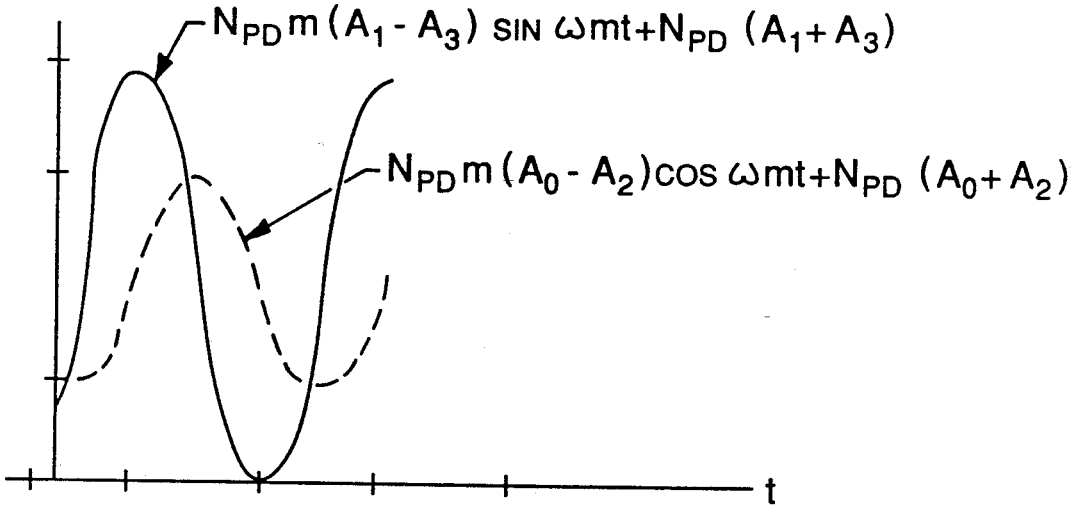
FIGS. 3 and 4 are charts respectively representing an original signal and a phase-shifted signal produced by the combined output of variable attenuators.
Figure 4:
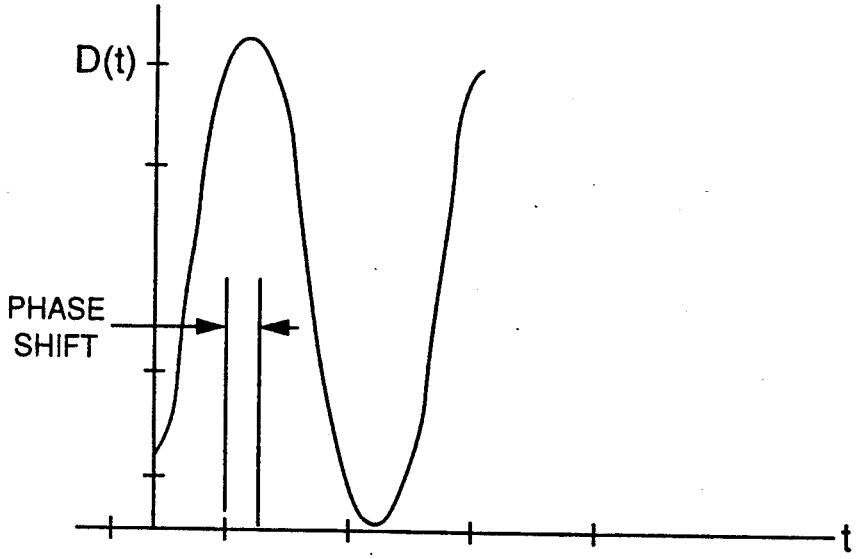

FIG. 2 is presented to help the reader visualize the shift in phase in the output of antenna element 100 of FIG. 1 as a function of the variable attenuators. FIG. 2 and 2B are phasor representations of signal $D_{100}(t)$. The phase of all other elements can be adjusted in a similar manner.

$$D_{100} = VA_{131}e^{jo} + VA_{132}e^{j}/2 + VA_{133}e^{j} + VAe^{j} \quad (1)$$
$$= (VA_{131} - VA_{133})e^{jo} + (VA_{132} - VA_{134})e^{j} \quad (2)$$
$$= Ae^{j\theta} \quad (3)$$

where:

$$A = [(VA_{131} - VA_{133})^2 + (VA_{132} - VA_{134})^2]^{\frac{1}{2}} \quad (4)$$

$$\theta = \arctan\left[\frac{(VA_{132} - VA_{134})}{(VA_{131} - VA_{133})}\right] \quad (5)$$

-continued $$D_{100}(t) = A\cos(wt + \theta) \quad (6)$$

In the system described above, the optical beam forming network produces the RF output as the same RF frequency as is input into the system. The shift in phase between the signals of adjacent antenna elements is produced by varying the amplitude weights provided by the variable attenuators 131–138 of FIG. 1. The maximum phase shift possible between two signals is 360 degrees. More specifically, the range of 180° occurs when $A_1-A_3=0$ and $A_0=0$;

+90° occurs when $A_3=0$ and $A_0-A_2=0$;

−90° occurs when $A_1=0$ and $A_0-A_2=0$; and

0° occurs when $A_1-A_3=0$ and $A_2=0$.

While the invention has been described in its presently preferred embodiment it is understood that the words which have been used are words of description rather than words of limitation an that changes within the purview of the appended claims may be made without departing from the scope and spirit of the invention in its broader aspects.

What is claimed is:

1. An optical microwave beamforming network comprising;

a means for producing a plurality of modulated light beams which all have the same modulation frequency but are separated from each other by a first difference in phase of the modulation signal;

a plurality of banks of variable attenuators in which each variable attenuator produces an optical output signal by receiving and attenuating one of the modulated coherent light beams from producing means;

a plurality of detectors, each of which outputs an RF electrical signal with adjusted phase by processing the optical output signals of all the variable attenuators in one of the banks of variable attenuators;

a means for amplifying the RF electrical signals produced by the plurality of detectors, said amplifying means producing thereby a plurality of amplified RF electrical signals with adjusted phase; and a plurality of radiating antenna elements, each of which are electrically connected to said amplifying means to receive therefrom one of said plurality of amplified RF electrical signals, said plurality of radiating RF antenna elements thereby radiating an RF waveform which is steered by the adjusted phase between the different amplified RF electrical signals.

2. An optical microwave beamforming network, as defined in claim 1, wherein said producing means comprises:

a plurality of lasers, each of which output a coherent light carrier beam;

a plurality of modulating signals wherein said modulating signals are separated in phase; and a plurality of modulators which each output are of the plurality of modulated coherent light beams by receiving and modulating one of the coherent light carrier beams from one of the lasers using one of the modulating signals from one of the generating means.

3. An optical microwave beamforming network, as defined in claim 1, wherein said amplifying means comprises a radar transmitter unit which contains a plurality of electrical amplifiers which each produce one of said amplified RF electrical signals by processing one of the RF electrical signals produced by one of the detectors.

4. An optical microwave beamforming network, as defined in claim 2, wherein said amplifying means comprises a radar transmitter unit which contains a plurality of electrical amplifiers which each produce one of said amplified RF electrical signals by processing one of the RF electrical signals produced by one of the detectors.

5. An optical microwave beamforming network, as defined in claim 2, wherein said generating means comprises a system controller unit which contains a microprocessor for outputting attenuator control signals to said banks of variable attenuators to control thereby the amounts of attenuation produced by each variable attenuator in its respective optical output signal.

6. An optical microwave beamforming network, as defined in claim 3, wherein said generating means comprises a system controller unit which contains a microprocessor for outputting attenuator control signals to said banks of variable attenuators to control thereby the amounts of attenuation produced by each variable attenuating in its respective optical output signal.

7. An optical microwave beamforming network, as defined in claim 4, wherein said generating means comprises a system controller unit which contains a microprocessor for outputting attenuator control signals to said banks of variable attenuators to control thereby the amounts of attenuation produced by each variable attenuating in its respective optical output signal.

8. An optical modulator, as defined in claim 2, wherein said plurality of lasers comprise: a first, second, third and fourth laser which output light carrier beams which are not coherent with each other, and wherein said plurality of modulators comprise: a first, second, third and fourth modulators which respectively produce a first, second, third and fourth modulated light beams which are separated from each other by 90 degrees in phase of the modulation signals.

9. An optical modulator, as defined in claim 3, wherein said plurality of lasers comprise: a first, second, third and fourth laser which output light carrier beams which are not coherent with each other, and wherein said plurality of modulators comprise: a first, second, third and fourth modulators which respectively produce a first, second, third and fourth modulated light beams which are separated from each other by 90 degrees in phase of the modulation signals.

10. An optical modulator, as defined in claim 4, wherein said plurality of lasers comprise: a first, second, third and fourth laser which output light carrier beams which are not coherent with each other and wherein said plurality of modulators comprise: a first, second, third and fourth modulators which respectively produce a first, second, third and fourth modulated light beams which are separated from each other by 90 degrees in phase of the modulation signals.

11. An optical modulator, as defined in claim 5, wherein said plurality of lasers comprise: a first, second, third and fourth laser which output light carrier beams which are not coherent with each other, and wherein said plurality of modulators comprise: a first, second, third and fourth modulators which respectively produce a first, second, third and fourth modulated coherent light beams which are separated from each other by 90 degrees in phase.

12. An optical modulator, as defined in claim 6, wherein said plurality of lasers comprise: a first, second, third and fourth laser which output light carrier beams which are not coherent with each other, and wherein said plurality of modulators comprise: a first, second, third and fourth modulators which respectively produce a first, second, third and fourth modulated coherent light beams which are separated from each other by 90 degrees in phase of the modulation signals.

13. An optical modulator, as defined in claim 7, wherein said plurality of lasers comprise: a first, second, third and fourth laser which output light carrier beams which are not coherent with each other, and wherein said plurality of modulators comprise: a first, second, third and fourth modulators which respectively produce a first, second, third and fourth modulated coherent light beams which are separated from each other by 90 degrees in phase of the modulation signals.

14. An optical beamforming network, as defined in claim 1, including a plurality of lens elements, each of which focus the optical output of one of the banks of variable attenuators onto one of the detectors, said lens elements thereby confining the outputs of a bank of variable attenuators to a single detector.

15. An optical beamforming network, as defined in claim 5, including a plurality of lens elements, each of which focus the optical output of one of the banks of variable attenuators onto one of the detectors, said lens elements thereby to confining the outputs of a bank of variable attenuators to a single detector.

16. An optical beamforming network, as defined in claim 8, including a plurality of lens elements, each of which focus the optical output of one of the banks of variable attenuators onto one of the detectors, said lens elements thereby confining the outputs of a bank of variable attenuators to a single detector.

17. An optical beamforming network, as defined in claim 9, including a plurality of lens elements, each of which focus the optical output of one of the banks of variable attenuators onto one of the detectors, said lens elements thereby confining the outputs of a bank of variable attenuators to a single detector.

18. An optical beamforming network, as defined in claim 10, including a plurality of lens elements, each of which focus the optical output of one of the banks of variable attenuators onto one of the detectors, said lens elements thereby confining the outputs of a bank of variable attenuators to a single detector.

19. An optical beamforming network, as defined in claim 11, including a plurality of lens elements, each of which focus the optical output of one of the banks of variable attenuators onto one of the detectors, said lens elements thereby confining the outputs of a bank of variable attenuators to a singlt detector.

20. An optical beamforming network, as defined in claim 12, including a plurality of lens elements, each of which focus the optical output of one of the banks of variable attenuators onto one of the detectors, said lens elements thereby confininf the outputs of a bank of variable attenuators to a singlt detector.

21. A process for microwave beamforming comprising the steps of:

producing a plurality of modulated light beams which are separated from each other by first differences in phase of the modulation signals;

adjustably attenuating each of said plurality of light beams to produce thereby a plurality fo combined beams which are separated from each other by second differences in phase of the modulation signals;

electrooptically converting the plurality of combined beams into RF electrical signals which remain separated from each other by said second differences in phase; and radiating said RF electrical signals using an array of antenna elements to produce thereby a radiated waveform which is steered by the second differences in phase.

22. A process, as described in claim 21, wherein said producing step is performed using a plurality of lasers which output a plurality of light carrier beams, and modulating the light carrier beams with a plurality of modulators to modulate the carrier beams with said first differences in phase thereto and produce thereby said plurality of modulated light beams.

23. A process, as defined in claim 22, wherein said attenuating step is performed using a plurality of banks of adjustable attenuators to produce thereby a plurality of sets of attenuated light beams and focusing each set of attenuated light beams with a plurality of lens elements onto a plurality of detectors to produce thereby said plurality of combined beams which are separated from each other by said second phase difference.

24. A process, as defined in claim 23, wherein said converting step is performed when said plurality of detectors electroptically convert said plurality of combined beams into said RF electrical signals.

25. A process, as defined in claim 24, wherein said radiating step is performed by amplifying said plurality of RF signals using amplifier elements of a radar transmitter, and radiating said RF electrical signals out of said array of antenna elements.

* * * * *